US005562143A

United States Patent [19]

Oberstadt

[11] Patent Number: 5,562,143

[45] Date of Patent: Oct. 8, 1996

[54] HINGED ARM AWNING

[75] Inventor: Theobald Oberstadt, Voorschoten, Netherlands

[73] Assignee: Unisol-Markisen Voss GmbH, Meerane, Germany

[21] Appl. No.: 347,815

[22] Filed: Nov. 30, 1994

[30] Foreign Application Priority Data

Dec. 8, 1993 [NL] Netherlands ..... 9302136

[51] Int. Cl.[6] ..... E04F 10/06

[52] U.S. Cl. ..... 160/70; 160/66; 160/71; 160/907

[58] Field of Search ..... 160/66, 69, 70, 160/71; 79, 80, 78, 907; 135/88.1

[56] References Cited

U.S. PATENT DOCUMENTS

| | | | |
|---|---|---|---|
| 1,742,234 | 1/1930 | Clifton | 160/70 |
| 3,364,973 | 1/1968 | Railson | 160/71 X |
| 5,273,095 | 12/1993 | Lukos | 160/70 |
| 5,292,169 | 3/1994 | O'Brian | 160/70 X |
| 5,340,187 | 8/1994 | Haddad, Jr. | 160/71 X |

FOREIGN PATENT DOCUMENTS

| | | | |
|---|---|---|---|
| 7241981 | 7/1973 | France . | |
| 3243025 | 5/1984 | Germany . | |
| 504042 | 4/1939 | United Kingdom | 160/70 |

*Primary Examiner*—Blair Johnson
*Attorney, Agent, or Firm*—Edwin D. Schindler

[57] ABSTRACT

A hinged arm awning with a support frame, in which a cloth roller is rotatably mounted, with hinged arms, which are pivotably mounted in brackets, and with a deployment rod, which tensions the end of the cloth and is flexibly connected to the bottom arm of the hinged arms. The technical problem lies in increasing the deployed length while maintaining the stability of a hinged arm awning. At least one arm (top arm 4 and/or bottom arm 5) of each hinged arm (3) forms an essentially right angle with the deployment rod (7) in the unfolded position and comprises a telescopic device which is preloaded in the deployment direction.

9 Claims, 4 Drawing Sheets

HINGED ARM AWNING

BACKGROUND OF THE INVENTION

1. Field of the Invention

The invention relates to a hinged arm awning with a support frame, in which a cloth roller is rotatably mounted, with hinged arms, which are pivotably mounted in brackets, and with a deployment rod, which tensions the end of the cloth and is flexibly connected to the bottom arms of the hinged arms.

2. Description of the Prior Art

FR-A-2 163 097 describes a hinged arm awning of the said type. Each arm of a hinged arm consists of two sectional pieces which are inserted in one another but cannot be moved with respect to one another. DE-A-3 243 025 also describes a hinged arm awning of the said type which comprises gas pressure springs to tension the hinged arms. The top and the bottom arms of the hinged arms are in each case of a fixed, invariable length.

As the hinged arms are folded up, the deployed length of awnings of this type is limited for design reasons approximately to the length of the hinged arms.

Nor does the use of telescopic rods instead of hinged arms improve the situation, as the telescopic rods lie parallel to the support frame in the retracted position, so that the extended length is limited in this case too. The telescopic rods always form an acute angle with the deployment rod. This limits the stability of the arrangement. If the telescopic rods are centrally articulated to the support frame, this will even produce an unstable triangular arrangement.

The object of the invention is to increase the deployed length while maintaining the stability of a hinged arm awning.

SUMMARY OF THE INVENTION

This object is solved according to the invention in that at least one arm (top arm and/or bottom arm) of each hinged arm forms an essentially right angle with the deployment rod in the unfolded position and comprises a telescopic device which is preloaded in the deployment direction.

The invention differs from the prior art in so far as this orientation of an arm at a right angle to the deployment rod enables the awning to be extended telescopically while maintaining the geometry of the hinged arms. This allows forces to be taken up in a highly stable manner and at favourable angles. As the deployment of the awning exceeds the length of the non-telescoped hinged arms, it can exceed the width of the awning. This is particularly important when used with narrow loggie.

Awnings of this type with telescopic arms are considerably more stable in windy conditions, as the comparatively slow-acting gas pressure springs of the telescopic devices check bulging of the awning cloth under wind loads to a large degree. The hinged joints in particular are as a result protected. The gas pressure springs also give the awning cloth a high degree of resilience when the awning is extended. This applies all the more when the hinged joints are locked in the unfolded position. The telescopic device acts essentially at a right angle to the deployment rod, so that the moments of force are always the same. The telescopic device does not exert any forces on the awning cloth at a right angle to the deployment direction, so that the latter is always uniformly tensioned.

In one embodiment the telescopic device is arranged in the top arm.

A particularly high level of stability is achieved by arranging the telescopic device in the bottom arm.

An arrangement in which the telescopic device comprises two tubular sectional parts which can slide in one another produces a telescopic guide which is free from play.

A small-volume actuating device is achieved by providing a spring, preferably a gas pressure spring, to preload the telescopic device.

In order to make the telescopic device active only in the unfolded position, an unlocking device which is automatically released in the unfolded position is provided for the telescopic device.

There is thus no possibility of the telescopic device being actuated in a folded position. This could result in undefinable operating states and unstable static conditions.

The hinged joint is securely locked in the unfolded position by providing as a locking device in the bottom arm a rod which engages in a recess in the top arm and comprises an actuating lever which is actuated by the telescopic device in the retracted position.

Defined operating conditions for the telescopic device are guaranteed by providing a locking device which is active in the unfolded position for the hinged joint.

The awning is reliably retracted by providing for each hinged joint a folding trigger device which acts as the cloth is retracted.

A simple folding trigger device is formed as a rod.

BRIEF DESCRIPTION OF THE DRAWINGS

Embodiments of the invention are explained with reference to the drawings, in which.

DESCRIPTION OF THE PREFERRED EMBODIMENT

Figure 1:
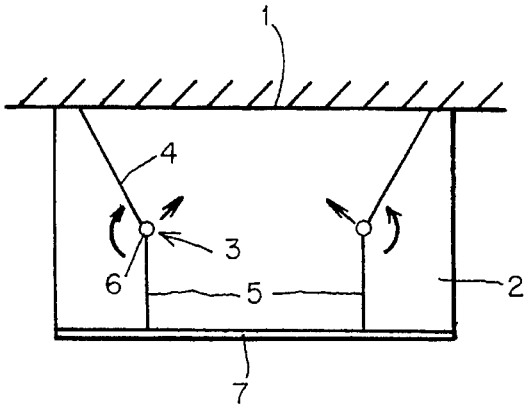
FIG. 1 (PRIOR ART)
FIG. 1 is a diagrammatic view of a conventional hinged arm awning.

FIG. 1 shows in diagrammatic form a support frame 1 which is secured to a facade or a wall and has a cloth roller, which is not shown, for a cloth 2. The support frame 1 may comprise a support tube, a box and/or brackets. Pivotable hinged arms 3 are seated in brackets which are secured to the facade or the support frame, the top arm 4 and bottom arm 5 of which hinged arms are coupled together by a hinged joint 6. The bottom arms 5 bear a deployment rod 7, to which the cloth 2 is secured. The bottom arms 5 form an essentially right angle with the deployment rod 7 in the deployed position. This is very favourable in terms of force factors. The hinged arms 3 are preloaded in the deployment direction by tension members, which are not shown, so that the cloth 2 is always held tautly. As the hinged arms 3 fold up, the extended length of this conventional awning arrangement is limited approximately to the length of a hinged arm.

Figure 2:
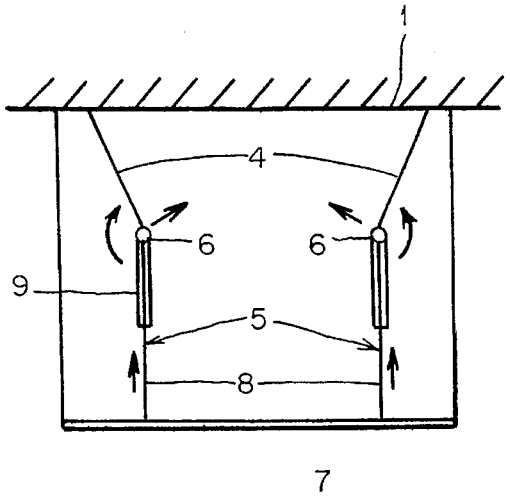
FIG. 2 is a diagrammatic view of a hinged arm awning according to the invention.

FIG. 2 represents an example of the invention. The bottom arms 5 in each case comprise a telescopic device in that an internal section 8 and an external section 9 can move in one another. The telescopic device is preloaded in the deployment direction, as will be explained in detail in the following. The telescopic device is released when the hinged arms are in the unfolded position. The hinged joints 6, whose limbs 4, 5 form an acute angle with one another, are locked towards one another in the unfolded position. The force factors are thus constant and reproducible.

Figure 3:
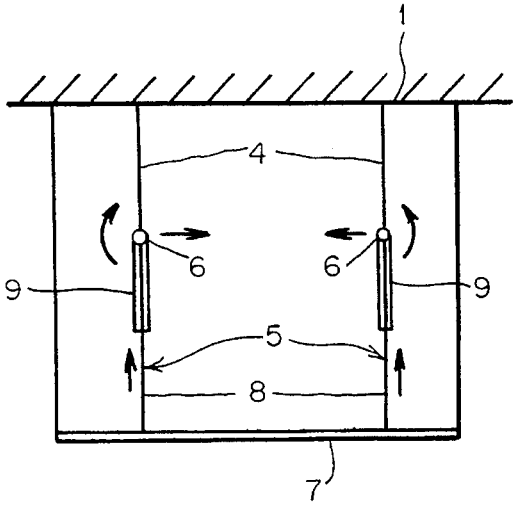
FIG. 3 is a diagrammatic view of a modified embodiment.

FIG. 3 shows another example of the invention. Here the limbs 4, 5 of the hinged arms 3 are at an angle of 180° in the unfolded position, so that the hinged arms take up a dead-centre position. A beyond dead-centre position is also possible. A comparison of FIGS. 2 and 3 with FIG. 1 clearly shows the technical effect achieved by the invention. The extended length of the awning is considerably greater than the unfolded length of a hinged arm.

Figure 4:
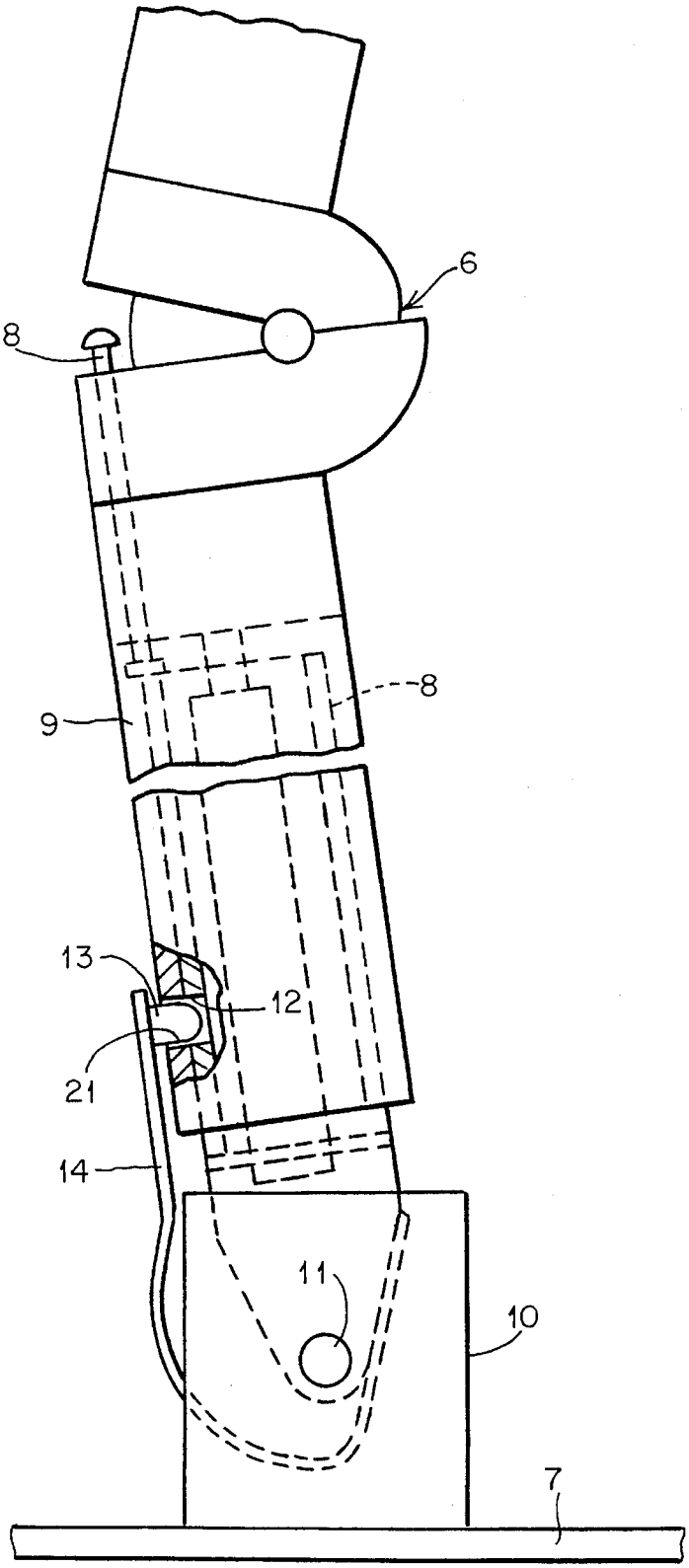
FIG. 4 shows a hinged arm in a bent position.
Figure 5:
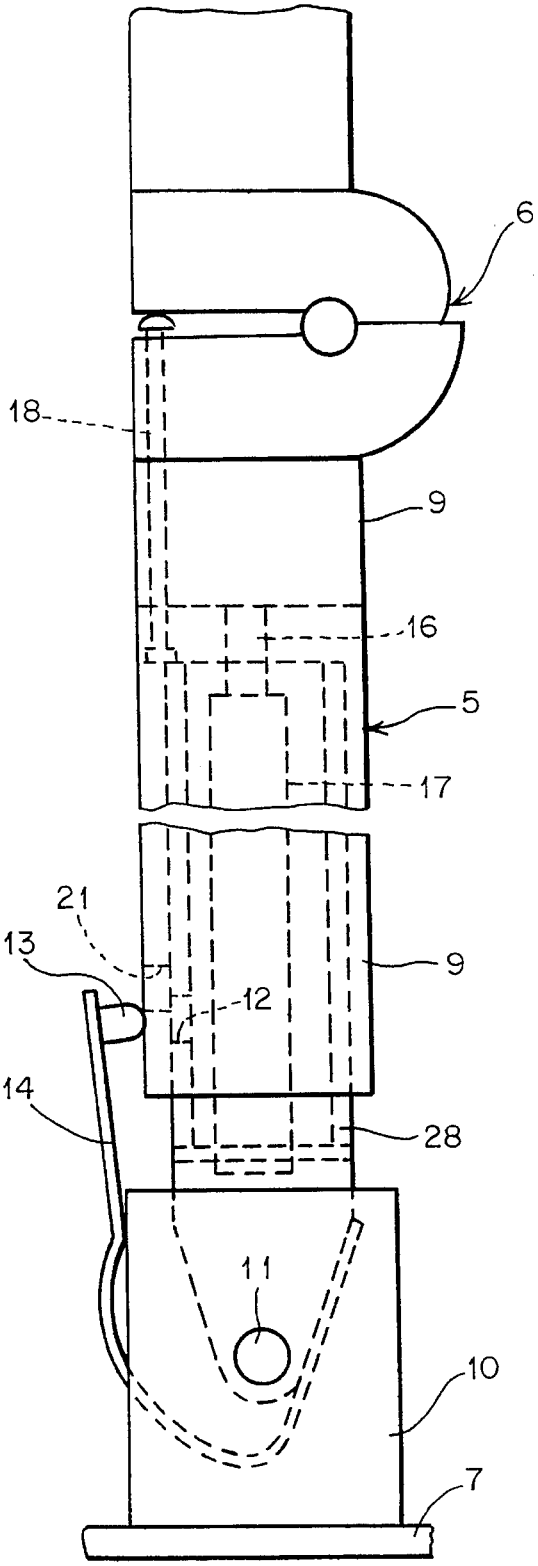
FIG. 5 shows the hinged arm in the unfolded position.
Figure 6:
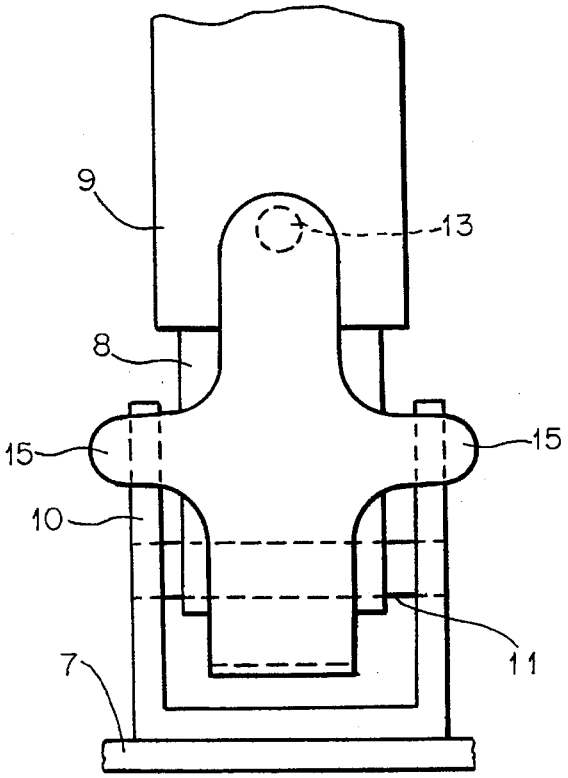
FIG. 6 is a rotated view of FIG. 5.

FIGS. 4 to 6 show details of the telescopic device. The bottom arm 5 comprises an internal section 8 and an external section 9. The internal section 8 holds on a pivot 11 a stirrup piece 10, to which the deployment rod 7 is secured. The internal section 8 and the external section 9 are coupled together by the piston rod 16 of a gas pressure spring 17.

The internal section 8 and the external section 9 comprise openings 12, 2I which can be aligned with one another and in which a pin 13 engages as locking device. The pin 13 is seated on a resilient tongue 14 with stop lugs 15. The tongue 14 is secured to the internal section 8 and preloaded in the locked position, so that the pin 13 normally engages in the openings 12, 21 and locks the telescopic device when the hinged arm is folded in. In the unfolded position according to FIGS. 5 and 6 the stop lugs 15 contact the stirrup piece 10, so that the pin 13 is lifted out of the openings 12, 21 and the telescopic device is unlocked. The gas pressure spring 17 is then active and extends the telescopic device via the piston rod 16.

The hinged joint 6 is locked in the unfolded position, as will be explained in the following. A rod 18 which acts as a folding trigger device is guided in the external section 9. When the cloth 2 is rolled up the telescopic devices are retracted and the gas pressure springs loaded. Finally, the internal section 8 contacts the rod 18, which folds in the hinged joint 6 and serves as a folding trigger device. The pin 13 engages in the openings 12 and locks the telescopic device.

Figure 7:
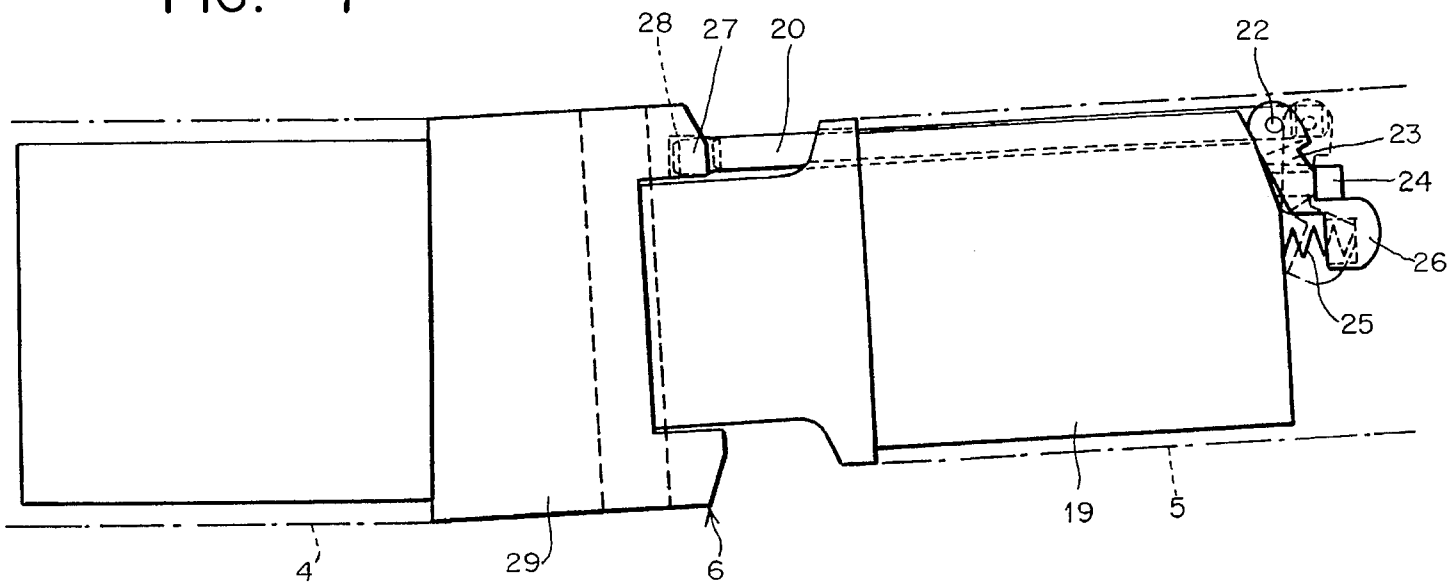
FIG. 7 shows a locking device for the hinged joint.
Figure 8:
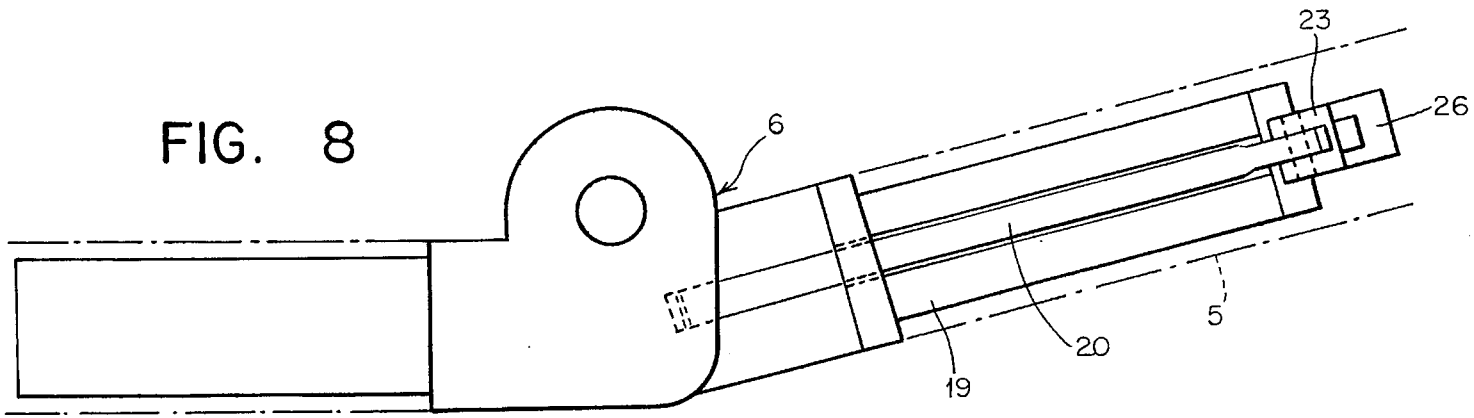
FIG. 8 is a plan view of FIG. 7.

FIGS. 7 and 8 show an embodiment of a locking device for the hinged joint 6. A rod 20, which is coupled to a lever 23 by a pivot 22, is guided on the holding part 19 of the bottom arm 5. The lever 23 is guided in a flexible manner on a pin 24 and preloaded by a spring 25. A lever head 26 comes to rest against the end face of the internal section, which is not shown, of the bottom arm, as a result of which the locking device is actuated as the telescopic device is retracted. The head 27 of the rod 20 engages in a recess 28 in the holding part 29 of the top arm 4 when the hinged arm is in the unfolded position, thus locking the hinged joint in the unfolded position.

I claim the following:

1. Hinged arm awning with a support frame, comprising a cloth roller being rotatably mounted, with hinged arms, each comrprising a top arm and a bottom arm, which are pivotably mounted in brackets, and with a deployment rod, which tensions an end of a cloth and is flexibly connected to the bottom arm of the hinged arms, said bottom arm including an internal section and an external section, said internal section and said external section being coupled together by a piston rod and a gas pressure spring, wherein at least one arm of each hinged arm forms a substantially right angle with the deployment rod in an unfolded position and comprises telescopic means operable during deployment, which is preloaded in the deployment direction, by activating said gas pressure spring which extends said telescopic means via sail piston rod.

2. Hinged arm awning according to claim 1, wherein the telescopic means is arranged in the top arm.

3. Hinged arm awning according to claim 1, wherein the telescopic means is arranged in the bottom arm.

4. Hinged arm awning according to claim 1, wherein the telescopic means comprises two tubular sectional parts which can slide in one another.

5. Hinged arm awning according to claim 1, wherein an unlocking means which is automatically released in the unfolded position is provided for the telescopic device.

6. Hinged arm awning according to claim 1, wherein a locking device which is active in the unfolded position is provided for the hinged joint.

7. Hinged arm awning according to claim 6, wherein a rod which engages in a recess in the top arm and comprises an actuating lever which is actuated by the telescopic means in the retracted position is provided as a locking device in the bottom arm.

8. Hinged arm awning according to claim 6, further comprising a folding trigger, which acts as the cloth is, is provided for each hinged joint.

9. Hinged arm awning according to claim 7, wherein the folding trigger means is formed as a rod which is actuated by the telescopic device.

* * * * *